US008029962B2

(12) United States Patent
Aoki et al.

(10) Patent No.: US 8,029,962 B2
(45) Date of Patent: Oct. 4, 2011

(54) DEVELOPING AGENT

(75) Inventors: Takayasu Aoki, Mishima (JP); Motonari Udo, Mishima (JP); Masahiro Ikuta, Mishima (JP); Tsuyoshi Itou, Izunokuni (JP); Takashi Urabe, Sunto-gun (JP); Takafumi Hara, Mishima (JP); Satoshi Araki, Izunokuni (JP); Yasuhito Noda, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 660 days.

(21) Appl. No.: 12/119,840

(22) Filed: May 13, 2008

(65) Prior Publication Data

US 2008/0286678 A1 Nov. 20, 2008

Related U.S. Application Data

(60) Provisional application No. 60/917,977, filed on May 15, 2007.

(51) Int. Cl.
*G03G 9/00* (2006.01)

(52) U.S. Cl. ..... 430/110.2; 430/110.1; 430/109.4

(58) Field of Classification Search ..... 430/108.1, 430/108.8, 109.1, 109.3, 110.2, 137.14, 109.4, 430/110.1

See application file for complete search history.

(56) References Cited

U.S. PATENT DOCUMENTS

| | | | | |
|---|---|---|---|---|
| 5,336,581 | A * | 8/1994 | Inaba et al. | 430/110.2 |
| 5,716,748 | A * | 2/1998 | Hasegawa et al. | 430/111.2 |
| 2006/0216628 | A1 * | 9/2006 | Nakamura et al. | 430/110.2 |
| 2007/0111124 | A1 * | 5/2007 | Yuasa et al. | 430/108.1 |
| 2007/0281240 | A1 | 12/2007 | Urabe et al. | |

FOREIGN PATENT DOCUMENTS

| | | |
|---|---|---|
| JP | 3141783 | 1/1998 |
| JP | 2004-191927 | 7/2004 |
| JP | 2005-055498 | 3/2005 |
| JP | 3716847 | 4/2005 |
| JP | 2006-084952 | 3/2006 |

OTHER PUBLICATIONS

Written Notice dated Feb. 1, 2011 corresponding to U.S. Appl. No. 12/119,840, filed on May 13, 2008.

Application for filing Published Documents dated Jan. 11, 2011 corresponding to U.S. Appl. No. 12/119,840, filed on May 13, 2008.

* cited by examiner

*Primary Examiner* — Mark F Huff
*Assistant Examiner* — Stewart A Fraser
(74) *Attorney, Agent, or Firm* — Turocy & Watson, LLP

(57) ABSTRACT

A developing agent including a core containing an amorphous polyester resin and a fatty acid ester based wax, a shell provided on the surface of the core and containing a copolymer of an aromatic vinyl monomer and acrylic acid or an acrylic ester, and a coloring agent.

8 Claims, 1 Drawing Sheet

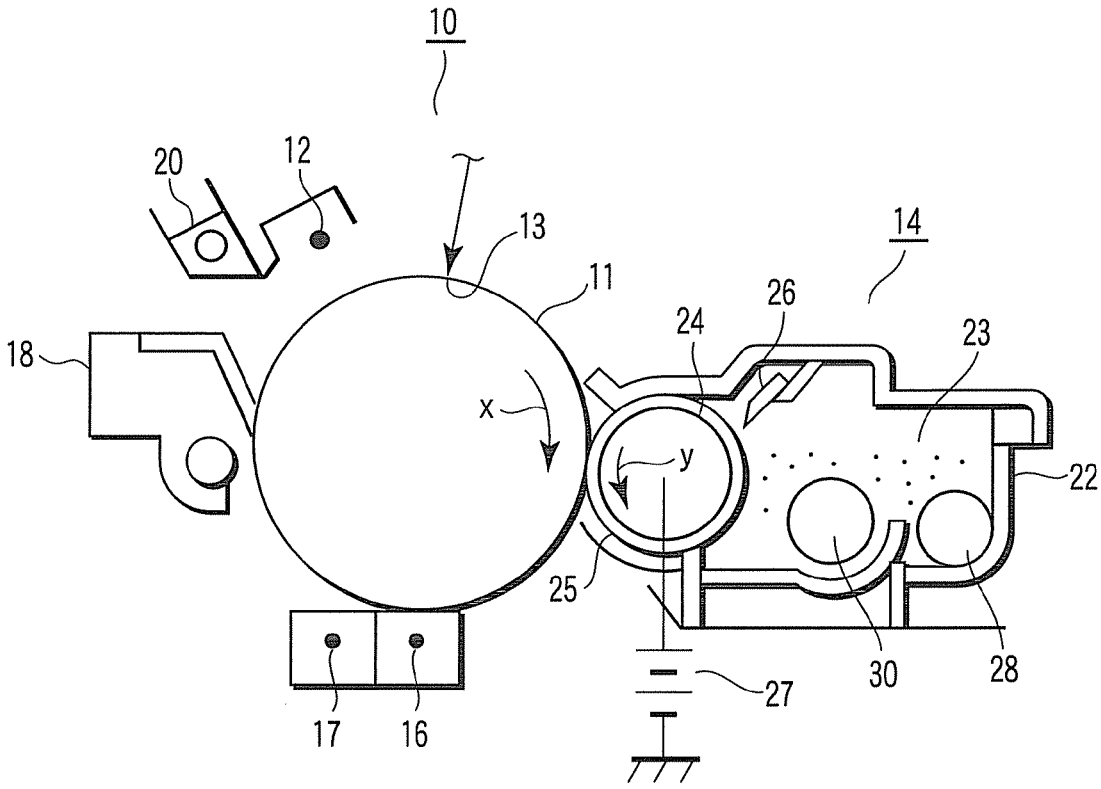
FIGURE

DEVELOPING AGENT

CROSS-REFERENCE TO RELATED APPLICATIONS

This application claims the benefit of U.S. Provisional Application No. 60/917,977, field May 15, 2007.

BACKGROUND OF THE INVENTION

1. Field of the Invention

The present invention relates to a developing agent for developing an electrostatic charge image or a magnetic latent image in an electrophotographic method, an electrostatic printing method, a magnetic recording method and the like and in particular, to an encapsulated developing agent.

2. Description of the Related Art

In the related-art production method of an electrostatic charge image developing toner, a kneading pulverization method was the main current. In the case of a toner particle to be produced by the kneading pulverization method, in general, its shape is amorphous, and its surface composition is heterogeneous. Though the shape or surface composition of the toner particle slightly changes depending upon pulverization properties of a material to be used or conditions of a pulverization step, it was difficult to intentionally control the shape. Also, the kneading pulverization method was limited in minimizing the particle size. Mechanical pulverization of a toner goes through steps of pulverization, classification and the like. When the particle size becomes small, the yield is lowered due to a reduction in the efficiency in the classification, and necessary energy increases. On the other hand, with the diffusion of a digital color system aiming at a higher image quality of these days, needs for realizing a small particle size of the toner have been increased. The small-particle sized toner is able to increase a coverage on a medium such as paper at a low consumption amount and is especially advantageous for colorization of electrophotography. Also, from the viewpoints of transfer properties and fixability, it is demanded to precisely control a toner particle regarding the toner shape, particle size distribution and encapsulation and the like. As a production method which meets these demands, the development of a toner by a polymerization method has been advanced in recent years.

Also, in recent years, in view of the matter that an image with higher image quality due to coloration is demanded, investigations of a polyester based resin which is able to be fixed at lower temperatures as a kind of a toner binder resin are being advanced. Furthermore, following the development of a polymerized toner, it is also actually investigated to encapsulate a core agent with a shell material. For example, as disclosed in Japanese Patent No. 3141783, there is proposed a production method by encapsulation in a dispersion. By performing the encapsulation, it becomes possible to achieve low-temperature fixing such that a releasing agent is not exposed on the toner surface.

In a developing agent, in general, a pigment and a releasing agent component are contained together with a binder resin. The releasing agent component is added for the purpose of widening an offset region of high temperature and low temperature in a fixing unit. In general, when the amount of the releasing agent component increases, releasing properties against a heat fusing roll are improved, and a non-offset region is widened, thereby contributing to electric power saving in a fixing step. But, especially in a state that the releasing agent component is exposed on the toner surface, a problem of filming on a control blade of a development unit or a surface of a photoreceptor is generated. Also, the preservability of the toner at high temperatures becomes worse, and a blocking phenomenon occurs. Then, an electrostatic charge image developing toner having an encapsulated structure in which a releasing agent is dispersed in a core resin, and a releasing agent component does not exist in a shell resin provided on the surface of the core resin has been demanded.

But, in the case where a toner is produced through dispersion and coagulation steps in an aqueous solution by forming a core agent by using a polyester based resin, the dispersibility of a pigment or a releasing agent in the core resin is a problem. When compatibility of the pigment or releasing agent with a so-called binder resin is poor, there is a possibility that the pigment or releasing agent is separated during the foregoing dispersion and coagulation steps. With respect to this point of issue, the case where the dispersion of the releasing agent is insufficient was seen even in the kneading step by the related-art pulverization method. However, in the production method of a polymerized toner by treatment in an aqueous solution, there may be the case where the pigment or releasing agent dispersion and the resin dispersion are completely separated, and severer compatibility is demanded. For example, as disclosed in Japanese Patent No. 3716847, a technology in which a toner has a core/shell structure, both a core resin and a shell resin are a polyester based resin, and a releasing agent is composed of an ester compound is reported. But, this technology involves defects that it is of a three-layered structure and is complicated in a process and that since the shell resin is a polyester based resin, in general, it is easily affected by an environmental fluctuation of the charge quantity. Also, for example, as disclosed in JP-A-2006-84952, a technology of encapsulating a polyester based core resin with a styrene-acrylic shell resin is reported. But, no particular description regarding a releasing agent is given, and there was a risk that the releasing agent is separated.

Also, as to the releasing agent, paraffin based materials or olefin based materials were frequently used. But, from the viewpoint of dispersion of a releasing agent in a polyester based resin, a releasing agent which is richer in compatibility has been desired.

In order to solve the foregoing problems, the invention is to provide a developing agent having excellent low-temperature fixability and satisfactory preservability and charge stability.

BRIEF SUMMARY OF THE INVENTION

The developing agent of the invention comprises a core containing an amorphous polyester resin and a fatty acid ester based wax;

a shell provided on the surface of the core and containing a copolymer of an aromatic vinyl monomer and acrylic acid or an acrylic ester; and a coloring agent to be further contained in at least one of the core and the shell.

According to the invention, a developing agent in which a releasing agent is hardly exposed on the toner surface and which has excellent low-temperature fixability and satisfactory preservability and charge stability is obtainable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGURE is a diagrammatic view showing an image forming apparatus to which the developing agent of the invention is applicable.

DETAILED DESCRIPTION OF THE INVENTION

The invention is concerned with a developing agent including a core containing a binder resin and a releasing agent, a shell provided on the surface of the core and a coloring agent to be contained in at least one of the core and the shell, which is characterized in that the binder resin is an amorphous polyester resin; that the releasing agent includes a fatty acid ester based wax; and that the shell contains a copolymer of an aromatic vinyl monomer and acrylic acid or an acrylic ester.

According to the invention, when an amorphous polyester resin is used as the binder resin, the preservability at a high temperature is excellent, and therefore, satisfactory low-temperature fixability can be realized.

Also, when a fatty acid ester based wax is used as the releasing agent, it is easy to disperse the ester group-containing polyester resin to be used as the binder resin and similarly having polarity.

Also, since the fatty acid ester based wax exists in the core covered by the shell, this wax component does not ooze out onto the surface of the developing agent during a time until the developing agent has been heated by a fixing mechanism, and the developing agent hardly causes blocking. Therefore, not only an environmental fluctuation rate of the charge quantity and preservability become satisfactory, but filming is hardly generated.

(Binder Resin Component of Core Material)

The polyester based resin is obtained by subjecting a dicarboxylic acid component and a diol component to polycondensation through an esterification reaction.

Examples of the acid component include aromatic dicarboxylic acids such as terephthalic acid, phthalic acid and isophthalic acid; and aliphatic carboxylic acids such as fumaric acid, maleic acid, succinic acid, adipic acid, sebacic acid, glutaric acid, pimelic acid, oxalic acid, malonic acid, citraconic acid and itaconic acid.

Examples of the alcohol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane and pentaerythritol; alicyclic diols such as 1,4-cyclohexanediol and 1,4-cyclohexanedimethanol; and ethylene oxide or propylene oxide adducts of bisphenol A or the like.

Also, the foregoing polyester component may be converted to have a crosslinked structure by using a trihydric or polyhydric carboxylic acid or polyhydric alcohol component such as 1,2,4-benzenetricarboxylic acid (trimellitic acid) and glycerin.

Furthermore, two or more kinds of such polyester resins having a different composition from each other may be mixed and used.

A glass transition temperature of the polyester resin is preferably from 45° C. to 70° C., and more preferably from 50° C. to 65° C. When the glass transition temperature is lower than 45° C., the heat-resistant preservability of the toner becomes worse, whereas when it is higher than 70° C., the low-temperature fixability becomes worse.

Also, a weight average molecular weight Mw of the polyester resin is preferably 5,000 or more and not more than 50,000, and more preferably 8,000 or more and not more than 20,000.

(Releasing Agent Component)

The dispersion form of the releasing agent component in the resin to be contained in the core is desirably a form in which a relatively large amount of the releasing agent is dispersed in the vicinity of the surface of the core. This is because in the transfer step of electrophotography, in order that the releasing agent may exhibit a releasing action in a transfer machine, it is required that the releasing agent properly bleeds on the surface of the toner. Accordingly, there is an optimal value with respect to the compatibility between the polyester resin as the core resin and the releasing agent component.

As the releasing agent component which can be used in the invention, a wax having a fatty acid ester bond composed of an alcohol component and a carboxylic acid component is especially used. From the viewpoint of low-temperature fixability, a softening point of the fatty acid ester based wax to be used in the invention is desirably from 60° C. to 120° C., and more desirably from 70° C. to 110° C.

Examples of the alcohol component include higher alcohols. Examples of the carboxylic acid component include saturated fatty acids having a linear alkyl group; unsaturated fatty acids such as monoenic acids and polyenic acids; and hydroxy fatty acids. Also, examples of the unsaturated polyhydric carboxylic acid include maleic acid, fumaric acid, itaconic acid and citraconic acid. Also, anhydrides of these acids can be used.

Examples of the fatty acid ester based wax to be used in the invention include vegetable waxes such as candelilla wax, carnauba wax, Japan wax, jojoba wax and rice wax; animal waxes such as bees wax, lanolin and whale wax; mineral waxes such as montan wax, ozokerite and ceresin; fatty acid amides such as linolic acid amide, oleic acid amide and lauric acid amide; and silicone based waxes. Also, examples of the fatty acid ester based wax include synthetic waxes such as waxes having an unsaturated polyhydric carboxylic acid, for example, maleic acid, fumaric acid, citraconic acid and itaconic acid.

The wax having an unsaturated polyhydric carboxylic acid can be, for example, produced by making at least one compound selected among long-chain alkyl group-containing alcohols, long-chain alkyl group-containing amines, fluoroalkyl group-containing alcohols and fluoroalkyl group-containing amines react with an unsaturated polyhydric carboxylic acid or an acid anhydride thereof and adding a reaction product thereof to a synthetic hydrocarbon wax using a compound capable of generating a free radical, for example, organic peroxides. Alternatively, the wax having an unsaturated polyhydric carboxylic acid can be obtained by first adding an unsaturated polyhydric carboxylic acid or an anhydride thereof to a synthetic hydrocarbon wax using an organic peroxide or the like and then making the adduct react with the foregoing alcohol or amine.

In the case where an α-olefin is used as the synthetic hydrocarbon wax, even when a compound capable of generating a free radical is not used in the reaction with an unsaturated polyhydric carboxylic acid or its derivative, the wax having an unsaturated polyhydric carboxylic acid can be produced utilizing a reaction by an unsaturated double bond at a high temperature.

The amount of the unsaturated polyhydric carboxylic acid or its acid anhydride to be used is preferably from 0.5 to 1.5 molar equivalents relative to the synthetic hydrocarbon wax;

and the amount of the alcohol or amine to be used is preferably from 0.2 to 3.0 molar equivalents relative to the synthetic hydrocarbon wax.

Examples of the long-chain alkyl group-containing alcohol or amine which can be used include octanol, dodecanol, stearyl alcohol, nonacosanol, pentadecanol, N-methylhexylamine, nonylamine, stearylamine and nonadecylamine. Also, examples of the fluoroalkyl group-containing alcohol or amine which can be used include 2-(perfluorobutyl)ethanol, 2-(perfluorohexyl)ethanol, 2-(perfluorooctyl)propanol, 1H,1H,7H-dodecafluoroheptanol, 4,4-hexafluoroisopropylidenediphenol, 2,2,3,3,3-pentafluoropropylamine and fluoroaniline.

Examples of the unsaturated polyhydric carboxylic acid or its anhydride include maleic acid, maleic anhydride, itaconic acid, itaconic anhydride, citraconic acid and citraconic anhydride. These compounds can be used singly or in admixture of two or more kinds thereof. Furthermore, an acid anhydride can be used; and moreover, maleic acid and maleic anhydride can be used in the invention.

Examples of the synthetic hydrocarbon wax include polyethylene waxes, polypropylene waxes, Fischer-Tropsch waxes and α-olefins. In the case where the foregoing reaction is carried out, an unreacted material partially remains, and in particular, when a liquid wax having a low melting point is used, staining of a fixing roller to be caused due to this unreacted material or blocking of the toner may possibly occur. On the other hand, in the case where a wax having a high melting point is used, the melting point of the reaction product itself becomes high, whereby the fixability at a low temperature becomes worse. Accordingly, as the synthetic hydrocarbon wax to be used in the invention, one having a melting point of from 50 to 150° C. is preferable.

As the compound capable of generating a free radical, for example, an organic peroxide is used. Examples thereof include di-tert-butyl peroxide, tert-butyl hydroperoxide, dicumyl peroxide, tert-butyl-cumyl hydroperoxide, cumyl hydroperoxide, 2,5-dimethyl-2,5-di(tert-butyl-peroxy)hexane, 2,5-dimethyl-2,5-di(tert-butyl-peroxy)hexine-3, tert-butyl-peroxyisopropyl monocarbonate, 1,1-bis(tert-butyl-peroxy)3,3,5-trimethylcyclohexane and methyl ethyl ketone peroxide. These compounds can be used singly or in admixture of two or more kinds thereof.

The releasing agent to be used in the invention is more preferably a compound prepared in such a manner that in its production step, in adding the unsaturated polyhydric carboxylic acid or its acid anhydride to the synthetic hydrocarbon wax, at least one compound selected among fluoroalkyl compounds, polysiloxane compounds and fluorosiloxane compound is added to the synthetic hydrocarbon wax together with the foregoing acid. Examples of the fluoroalkyl compound to be added include 1-methoxy-(perfluoro-2-methyl-1-propane), hexafluoroacetone, 3-perfluorooctyl-1,2-epoxypropane, 3-(1H,1H,5H-octafluoropentyloxy)-1,2-epoxypropane, 3-(2,2,3,3-tetrafluoropropoxy)-1,2-epoxypropane, 2-(perfluorobutyl)ethyl bromide and perfluorooctyl bromide.

Examples of commercially available products of the releasing agent produced by the foregoing production method include CANAX L-171, CANAX J-797, CANAX L-142, MP-WAX and L-996, all of which are manufactured by Chukyo Yushi Co., Ltd.

(Resin Component of Shell Material)

Examples of the resin which is used as the shell material in the invention include copolymers of an aromatic vinyl component and acrylic acid or an acrylic ester such as styrene-acrylic copolymers. Examples of the aromatic vinyl component include styrene, α-methylstyrene, o-methylstyrene and p-chlorostyrene. Also, a sulfonic acid based vinyl monomer such as sodium p-styrenesulfonate can be used as the aromatic vinyl monomer. Examples of the acrylic ester component include ethyl acrylate, propyl acrylate, butyl acrylate, 2-ethylhexyl acrylate, butyl methacrylate, ethyl methacrylate and methyl methacrylate. Of these, it is general to use butyl acrylate. As the polymerization method, an emulsion polymerization method is generally employed, and the resin is obtainable by radical polymerization of monomers of the respective components in an aqueous phase containing an emulsifier.

As a coloring agent to be used in the invention, carbon black, organic or inorganic pigments or dyes and the like are used.

Examples of the carbon black include acetylene black, furnace black, thermal black, channel black and ketjen black.

Also, examples of the pigment or dye include Fast Yellow G, Benzidine Yellow, Indo Fast Orange, Irgazin Red, Naphthol Azo, Carmine FB, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green and quinacridone.

In the invention, these compounds can be used singly or in admixture.

In the invention, a charge controlling agent for controlling a triboelectrostatic charge quantity or the like may be blended. As the charge controlling agent, a metal-containing azo compound can be used, and complexes or complex salts in which a metal element thereof is iron, cobalt or chromium, or mixtures thereof are desired. Also, a metal-containing salicylic acid derivative compound is used, and complexes or complex salts in which a metal element thereof is zirconium, zinc, chromium or boron, or mixtures thereof are desired.

In the invention, in order to adjust fluidity or charge properties with respect to the toner particle, an inorganic fine particle may be externally added and mixed in an amount of from 0.01 to 20% by weight relative to the total weight of the toner particle on the surface of the toner particle. As such an inorganic fine particle, silica, titania, alumina, strontium titanate, tin oxide and so on can be used singly or in admixture of two or more kinds thereof. From the viewpoint of an enhancement of environmental stability, it is preferable to use an inorganic fine particle which has been subjected to a surface treatment with a hydrophobic agent. Also, in addition to such an inorganic oxide, a resin fine particle of not larger than 1 μm can be externally added for the purpose of enhancing cleaning properties.

In the invention, a surfactant can be used in finely pulverizing the binder resin, the coloring agent and the wax.

Examples of an anionic surfactant include sulfonic acid salts such as alkylbenzenesulfonates, alkylnaphthalenesulfonates, alkyl diphenyl ether disulfonates and alkanesulfonates; fatty acid salts such as oleic acid salts, stearic acid salts and palmitic acid salts; sulfuric acid ester salts such as lauryl sulfate salts and lauryl ether sulfate salts; and alkenyl succinic acid salts.

Examples of a cationic surfactant include amine salts such as laurylamine salts, oleylamine salts and stearylamine salts; and quaternary ammonium salts such as lauryltrimethylammonium salts, stearyltrimethylammonium salts, distearyldimethylammonium salts and alkylbenzyldimethylammonium salts.

Examples of a nonionic surfactant include polyoxyethylene alkyl ethers such as polyoxyethylene lauryl ether, polyoxyethylene stearyl ether and polyoxyethylene myristyl ether; polyoxyalkylene alkyl ethers such as polyoxyethylene alkylene alkyl ethers and polyoxyethylene polyoxypropylene glycol; and sorbitan fatty acid esters such as sorbitan monolaurate, sorbitan monopalmitate and sorbitan monostearate.

In the invention, a water-soluble metal salt can be used in the coagulation step of the core material and the heterogeneous coagulation step of the core material and the shell material.

With respect to the metal salt, examples of a monovalent metal salt include sodium chloride, potassium chloride, lithium chloride and sodium acetate; examples of a divalent metal salt include magnesium sulfate, calcium chloride, magnesium chloride and zinc chloride; and examples of a trivalent salt include aluminum sulfate, aluminum hydroxide, poly (aluminum chloride), lanthanum chloride and lanthanum acetate.

In the invention, the production device of a resin fine particle by mechanical shearing is not particularly limited. Examples thereof include medium-free stirrers such as ULTRA TURRAX (manufactured by IKA Japan K.K.), T.K. AUTO HOMO MIXER (manufactured by PRIMIX Corporation), T.K. PIPELINE HOMO MIXER (manufactured by PRIMIX Corporation), T.K. FILMICS (manufactured by PRIMIX Corporation), CLEAR MIX (manufactured by MTECHNIQUE Co., Ltd.), CLEAR SS5 (manufactured by MTECHNIQUE Co., Ltd.), CAVITRON (manufactured by EUROTEC, Ltd.) and FINE FLOW MILL (manufactured by Pacific Machinery & Engineering Co., Ltd.); and high-pressure homogenizer types such as a Manton-Gaulin type high-pressure homogenizer (manufactured by Niro Soavi), MICROFLUIDIZER (manufactured by Mizuho Industrial Co., Ltd.), NANO-MIZER (manufactured by Nano-Mizer), ULTIMIZER (manufactured by Sugino Machine Limited), GENUS PY (manufactured by Hakusui Chemical Industries, Ltd.) and NANO3000 (manufactured by Biryu Co., Ltd.).

The developing agent of the invention can be, for example, encapsulated in the following manner.

In the invention, the encapsulated structure takes a structure in which a core material is formed as a core, and a shell material is deposited on a surface thereof. A volume average particle size of the core material is desirably from 0.5 μm to 15 μm, and more desirably from 2 μm to 10 μm. On the other hand, a volume average particle size of the shell material is smaller than that of the core material. The volume average particle size of the shell material is desirably from 50 nm to 800 nm, and more desirably from 70 nm to 300 nm. The core material can be one in which a primary particle thereof has a volume average particle size of the foregoing range or may be one in which a secondary or tertiary particle thereof obtained by coagulating a primary particle has a volume average particle size of the foregoing range.

With respect to the core material, a method in which a primary particle is prepared in a production step of a dispersion and then coagulated in a coagulation step to obtain a particle having a desired volume average particle size is employed. The shell material is generally prepared by emulsion polymerization; and the number of formed particles is determined and the particle size is fixed by the micelle number to be determined by a concentration of an emulsifier or a concentration of an initiator at the emulsion polymerization (see Kobunshi Ratekkusu No Kagaku (Chemistry of Synthetic Latex), written by MUROI, Soichi). In general, a primary particle formed by emulsion polymerization can be used as the shell material particle.

A step of depositing the shell material particle on the surface of the core material particle is called heterogeneous coagulation, and particles having different volume average particle size or physical properties from each other are coagulated. A weight ratio of the core particle and the shell particle is desirably from 90/10 to 70/30, and more desirably from 85/15 to 75/25. An optimal ratio is determined from a coverage of the shell particle on the core particle. When the weight ratio of the shell particle is too small, the coverage as an encapsulated particle decreases, whereas the weight ratio of the shell material particle is too large, homogeneous coagulation of the shell material particles each other occurs, whereby an optimal encapsulated particle is not obtainable. Also, at the heterogeneous coagulation, in general, the shell material particle is deposited on the surface of the core particle by making the dispersion state temporarily unstable by using a metal salt or the like. However, when the amount of the metal salt is too large, homogeneous coagulation of the shell material particles each other easily occurs. On the other hand, when the amount of the metal salt is too small, the shell material particle is not deposited on the surface of the core material particle. In general, a pH of the liquid at the heterogeneous coagulation is favorably from 2 to 9. By adjusting the pH, the coagulation properties can be controlled. Also, in general, in the case of performing heterogeneous coagulation in such particles having a different volume average particle size from each other, there is a tendency that particles having a small volume average particle size are easily coagulated each other, and in order to obtain a particle in an encapsulated state, subtle adjustment is required. The toner particle having been encapsulated by heterogeneous coagulation goes through a fusion step. The fusion step as referred to herein is carried out for the purposes of melting a part of the shell material particle deposited on the surface of the core material particle and more strengthening binding of the shell material particles each other and between the core material particle and the shell material particle. In general, the fusion step is carried out upon heating at a glass transition temperature of the binder resin or higher. When this fusion step is insufficient, there is a possibility that the coagulated particle is redispersed.

FIGURE is a diagrammatic view showing an embodiment of an image forming apparatus to which the developing agent of the invention is applicable.

A charging unit 12, an exposure section 13, a development device 14, a transfer unit 16, a peeling unit 17, an optional cleaning device 18 and a destaticization unit 20 are successively disposed on the periphery of a photoconductor 11 along the rotation of an arrow x direction thereof in the image forming apparatus 10 according to the present invention.

A developing agent 23 composed of a toner and a carrier is contained in a toner container 22 of the developing device 14, and a multipolar magnet roller 24 and a development sleeve 25 installed on the outer periphery thereof are placed in the developing device 14 on the side of the photoconductive drum 11.

The carrier of the developing agent 23 is deposited on the surface of the development sleeve 25 due to a magnetic force of the multipolar magnet roller 24, and the toner is deposited on the surface of the carrier to form a toner layer. The multipolar magnet roller 24 is fixed; the development sleeve 25 is rotated in an arrow y direction; and the developing agent 23 is conveyed at all times in conformity with this rotation.

Also, the conveyance amount of the developing agent 23 is controlled by a control blade 26. 27 denotes a power source for applying a development bias; and the toner is deposited on an electrostatic latent image on the photoconductive drum 11 from the development sleeve 25 due to an electrostatic attractive force in a place where the photoconductive drum 11 and the development sleeve 25 come close to each other, whereby the development is achieved to obtain a developing agent image. 28 and 30 each denotes an agitation roller for agitating and conveying the developing agent 23 containing the toner in the toner container 22 to frictionally electrifying the toner.

The developing agent image is transferred onto a material to be transferred (not illustrated), for example, paper, which is introduced between the transfer unit 16 and the photoconductive drum 11, by the transfer unit 16. Thereafter, the material to be transferred is separated from the periphery of the photoconductive drum 11 by the peeling unit 17, and then conveyed and contained.

EXAMPLES

The invention is specifically described below with reference to the following Examples.

(Production of Amorphous Polyester Resin A)

39 parts of terephthalic acid, 61 parts of an ethylene oxide compound of bisphenol A and 0.2 parts of dibutyltin were thrown into an esterification reaction vessel and subjected to a polycondensation reaction at 260° C. and 50 kPa for 5 hours under a nitrogen atmosphere, thereby obtaining a polyester resin. A glass transition temperature Tg was 60° C., and a melting point was 110° C.

(Production of Amorphous Polyester Resin B)

19 parts of terephthalic acid, 12 parts of fumaric acid, 69 parts of a propylene oxide compound of bisphenol A and 0.2 parts of dibutyltin were thrown into an esterification reaction vessel and subjected to a polycondensation reaction at 260° C. and 50 kPa for 5 hours under a nitrogen atmosphere, thereby obtaining a polyester resin. A glass transition temperature Tg was 61° C., and a melting point was 105° C.

(Production of Amorphous Polyester Resin C)

19 parts of terephthalic acid, 12 parts of succinic acid, 69 parts of a propylene oxide compound of bisphenol A and 0.2 parts of dibutyltin were thrown into an esterification reaction vessel and subjected to a polycondensation reaction at 260° C. and 50 kPa for 5 hours under a nitrogen atmosphere, thereby obtaining a polyester resin. A glass transition temperature Tg was 63° C., and a melting point was 112° C.

(Production of Styrene-Acrylic Resin D)

90 parts of styrene, 9.5 parts of n-butyl acrylate, 0.5 parts of acrylic acid, 1.5 parts of tertiary dodecyl mercaptan as a chain transfer agent and 0.5 parts of LATEMUL PS, manufactured by Kao Corporation as an emulsifier were added, and 0.8 parts of ammonium persulfate as a polymerization initiator was added to achieve emulsion polymerization at 60° C. A glass transition temperature was 80° C., and a weight average molecular weight was 35,000.

(Production of Styrene-Acrylic Resin E)

90 parts of styrene, 8.5 parts of n-butyl acrylate, 1.5 parts of acrylic acid, 1.5 parts of tertiary dodecyl mercaptan as a chain transfer agent and 0.5 parts of LATEMUL PS, manufactured by Kao Corporation as an emulsifier were added, and 0.8 parts of ammonium persulfate as a polymerization initiator was added to achieve emulsion polymerization at 60° C. A glass transition temperature was 83° C., and a weight average molecular weight was 32,000.

(Production of Styrene-Acrylic Resin F)

90 parts of styrene, 10 parts of n-butyl acrylate, 100 ppm of sodium p-styrenesulfonate, 1.5 parts of tertiary dodecyl mercaptan as a chain transfer agent and 0.5 parts of LATEMUL PS, manufactured by Kao Corporation as an emulsifier were added, and 0.8 parts of ammonium persulfate as a polymerization initiator was added to achieve emulsion polymerization at 60° C. A glass transition temperature was 80° C., and a weight average molecular weight was 25,000.

(Production of Core Resin Agent Dispersion)

30 parts by weight of the foregoing amorphous polyester resin A, 1.5 parts by weight of an anionic surfactant (NEOPELEX G-65, manufactured by Kao Corporation), 1 part by weight of an amine compound (triethylamine, manufactured by Wako Pure Chemical Industries, Ltd.) and 67.5 parts by weight of ion exchange water were thrown into CLEAR MIX (CLM-2.2S, manufactured by MTECHNIQUE Co., Ltd.). After the sample temperature reached 100° C., the revolution number of the CLEAR MIX was set up at 18,000 rpm, and the mixture was stirred for 30 minutes. After cooling, a volume average particle size of the resulting resin fine particle was measured by SALD7000 (manufactured by Shimadzu Corporation). As a result, the volume average particle size was 120 nm. With respect to the polyester resins B and C, dispersions were produced in the same manner.

(Production of Cyan Pigment Dispersion)

20 parts by weight of a cyan pigment (copper phthalocyanine, manufactured by Dainichiseika Color & Chemicals Mfg Co., Ltd.) and 1 part by weight of an anionic surfactant (NEOPELEX G-65, manufactured by Kao Corporation) were mixed with 79 parts by weight of ion exchange water, and the mixture was treated for 60 minutes in a homogenizer (ULTRA TURRAX T50, manufactured by IKA Japan K.K.) to obtain a pigment dispersion having a volume average particle size of 207 nm. The measurement of particle size distribution was performed by SALD7000, manufactured by Shimadzu Corporation.

(Production of Releasing Agent Dispersion Wax A)

20 parts by weight of a rice wax (manufactured by NS Chemical) and 1 part by weight of an anionic surfactant (NEOPELEX G-65, manufactured by Kao Corporation) were mixed with 79 parts by weight of ion exchange water, and the mixture was treated for 10 minutes while heating in a homogenizer (manufactured by IKA Japan K.K.) to obtain a releasing agent dispersion A having a volume average particle size of 152 nm. The measurement of particle size distribution was performed by SALD7000, manufactured by Shimadzu Corporation.

(Production of Releasing Agent Dispersion Wax B)

A releasing agent dispersion B was obtained in the same method, except for changing the foregoing rice wax to a carnauba wax (manufactured by Toakasei Co., Ltd.).

(Production of Releasing Agent Dispersion Wax C)

A releasing agent dispersion C was obtained in the same method, except for changing the foregoing rice wax to a maleinated wax (MP-WAX L-996, manufactured by Chukyo Yushi Co., Ltd.).

(Production of Releasing Agent Dispersion Wax D)

A releasing agent dispersion D was obtained in the same method, except for changing the foregoing rice wax to a polypropylene wax (manufactured by Mitsui Chemicals, Inc.).

Example 1

90 parts by weight of a dispersion of the amorphous polyester resin A in terms of solids content, 5 parts by weight of the releasing agent dispersion WAX A in terms of solids content and 5 parts by weight of the cyan pigment dispersion in terms of solids content were treated at normal temperature for 5 minutes in a homogenizer (manufactured by IKA Japan K.K.) to produce a mixed dispersion 1. 89 parts by weight of this in terms of solids content was charged into a stirrer-equipped glass-made separable flask. The mixed solution was heated to 65° C. in a water bath for heating while revolving a stirring blade at 300 rpm. Then, a magnesium sulfate aqueous solution was continuously added dropwise by a pump. 2 parts by weight of a magnesium sulfate aqueous solution in terms of solids content was charged, and after completion of the dropwise addition, the temperature was kept at 65° C. After two hours, a volume average particle size was measured by a Coulter counter particle size analyzer (manufactured by Beckman Coulter Inc.). As a result, it was found to be 5.2 μm. 1 part by weight of a nonionic surfactant (EMULGEN 1108, manufactured by Kao Corporation) was added in this coagulation solution in the state at 65° C., and 1 part by weight of an aluminum sulfate aqueous solution in terms of solids contents was further added. Then, 20 parts by weight of an emulsion of the styrene-acrylic resin D in terms of solids content as the shell material was added, and the mixture was allowed to stand at 65° C. for 2 hours. After cooling, the resulting colored particle was washed with washing water by a centrifuge until the conductivity became 50 μS/cm and dried by a vacuum dryer until the water content became 0.3 wt %. After drying, 2 parts by weight of hydrophobic silica (RX-200, manufactured by Nippon Aerosil Co., Ltd.) and 0.5 parts by weight of titanium oxide (STT-30EHJ, manufactured by Titan Kogyo K.K.) were deposited on the colored particle surface, whereby a desired electrophotographic toner could be obtained.

A volume average particle size of the foregoing electrophotographic toner was measured by a Coulter counter. As a result, it was found to be 5.8 μm.

The foregoing electrophotographic toner was mixed with a carrier in a prescribed ratio, and the mixture was thrown into a complex machine e-STUDIO 281c, manufactured by Toshiba Tec Corporation which had been modified for the evaluation, and by changing a heat roller temperature of a fixing machine from 110° C. to 190° C., the fixability was evaluated in terms of a non-offset region. The case where a non-offset temperature width was 45° C. or higher was defined as "AA"; the case where it was 40° C. or higher and lower than 45° C. was defined as "BB"; and the case where it was 30° C. or higher and lower than 40° C. was defined as "CC".

Here, no offset was generated at from 118° C. to 160° C., and the non-offset temperature width was 42° C.

With respect to a preservability test of the toner, the toner was allowed to stand under warm water at 50° C. for 8 hours, and thereafter, the toner was taken out, subjected to tapping and then placed on a sieve. The case where the amount of the toner on the sieve was not more than 0.5% was defined as "AA"; and the case where it was more than 0.5% was defined as "BB". The preservability test revealed 0.2%.

With respect to a charge stability test of the toner, the foregoing electrophotographic toner and carrier were allowed to stand for 8 hours or more under a low-temperature low-humidity environment (at 10° C. and 20%) and a high-temperature high-humidity environment (at 30° C. and 85%), respectively. After standing, the charge quantity was measured by a suction blow-off instrument (TTB-203, manufactured by Kyocera Chemical Corporation). The charge-quantity (hereinafter referred to as "q/m [L/L]") of the toner which had been allowed to stand at low temperature and low humidity was −35.0 (μC/g); and the charge quantity (hereinafter referred to as "q/m [H/H]") of the toner which had been allowed to stand at high temperature and high humidity was found to be −32.0 (μC/g). As an index of the environmental stability of the charge quantity, an environmental fluctuation rate was calculated according to the following expression. As a result, it was found to be 0.91. When the environmental fluctuation rate is 0.80 or more, a satisfactory image can be obtained irrespective of the environmental atmosphere. The case where the environmental fluctuation rate was 0.80 or more was defined as "AA"; and the case where it was less than 0.80 was defined as "BB".

$$\text{Environmental fluctuation rate} = q/m[H/H]/q/m[L/L]$$

After a paper-passing test, the generation state of filming was confirmed from staining of a photoconductive drum. The case where filming was not observed was defined as "AA"; and the case where the generation of filming was observed was defined as "BB". The generation of filming was not observed.

Example 2

90 parts by weight of a dispersion of the amorphous polyester resin B in terms of solids content, 5 parts by weight of the releasing agent dispersion WAX B in terms of solids content and 5 parts by weight of the cyan pigment dispersion in terms of solids content were treated at normal temperature for 5 minutes in a homogenizer (manufactured by IKA Japan K.K.) to produce a mixed dispersion 1. Also, an emulsion of the styrene-acrylic resin E as the shell material was used. Other conditions were the same as in Example 1. The resulting particle size was 5.5 μm. As a result of the fixing test, no offset was generated at from 120° C. to 164° C., and the non-offset temperature width was 44° C. The preservability test revealed 0.3%; and the environmental fluctuation rate of the charge quantity was 0.85. The generation of filming was not observed.

Example 3

90 parts by weight of a dispersion of the amorphous polyester resin C in terms of solids content, 5 parts by weight of the releasing agent dispersion WAX C in terms of solids content and 5 parts by weight of the cyan pigment dispersion in terms of solids content were treated at normal temperature for 5 minutes in a homogenizer (manufactured by IKA Japan K.K.) to produce a mixed dispersion 1. Also, an emulsion of the styrene-acrylic resin D as the shell material was used. Other conditions were the same as in Example 1. The resulting particle size was 5.0 μm. As a result of the fixing test, no offset was generated at from 123° C. to 165° C., and the non-offset temperature width was 42° C. The preservability test revealed 0.2%; and the environmental fluctuation rate of the charge quantity was 0.87. The generation of filming was not observed.

Example 4

90 parts by weight of a dispersion of the amorphous polyester resin C in terms of solids content, 5 parts by weight of the releasing agent dispersion WAX C in terms of solids content and 5 parts by weight of the cyan pigment dispersion in terms of solids content were treated at normal temperature for 5 minutes in a homogenizer (manufactured by IKA Japan K.K.) to produce a mixed dispersion 1. Also, an emulsion of the styrene-acrylic resin F as the shell material was used. Other conditions were the same as in Example 1. The resulting particle size was 4.6 μm. As a result of the fixing test, no offset was generated at from 122° C. to 169° C., and the non-offset temperature width was 47° C. The preservability test revealed 0.2%; and the environmental fluctuation rate of the charge quantity was 0.92. The generation of filming was not observed.

Comparative Example 1

90 parts by weight of a dispersion of the amorphous polyester resin A in terms of solids content, 5 parts by weight of the releasing agent dispersion WAX A in terms of solids content and 5 parts by weight of the cyan pigment dispersion in terms of solids content were treated at normal temperature for 5 minutes in a homogenizer (manufactured by IKA Japan K.K.) to produce a mixed dispersion 1. A coagulation step was carried out in the same manner as in Example 1. An electrophotographic toner was obtained in the same method as in Example 1, except for using only the core material without performing the heterogeneous coagulation. The resulting particle size was 5.6 μm. As a result of the fixing test, no offset was generated at from 118° C. to 159° C., and the non-offset temperature width was 41° C. The preservability test revealed 0.8%; and the environmental fluctuation rate of the charge quantity was 0.72. Filming was generated.

Comparative Example 2

90 parts by weight of a dispersion of the amorphous polyester resin C in terms of solids content, 5 parts by weight of the releasing agent dispersion WAX D in terms of solids content and 5 parts by weight of the cyan pigment dispersion in terms of solids content were treated at normal temperature for 5 minutes in a homogenizer (manufactured by IKA Japan K.K.) to produce a mixed dispersion 1. Also, an emulsion of the styrene-acrylic resin D as the shell material was used. Other conditions were the same as in Example 1. The resulting particle size was 4.6 μm. As a result of the fixing test, no offset was generated at from 120° C. to 152° C., and the non-offset temperature width was 32° C. The preservability test revealed 0.2%; and the environmental fluctuation rate of the charge quantity was 0.82. The generation of filming was not observed.

Comparative Example 3

90 parts by weight of a dispersion of the amorphous polyester resin A in terms of solids content, 5 parts by weight of the releasing agent dispersion WAX A in terms of solids content and 5 parts by weight of the cyan pigment dispersion in terms of solids content were treated at normal temperature for 5 minutes in a homogenizer (manufactured by IKA Japan K.K.) to produce a mixed dispersion 1. Also, 5 parts by weight of an emulsion of the styrene-acrylic resin D as the shell material was used. Other conditions were the same as in Example 1. The resulting particle size was 5.2 μm. As a result of the fixing test, no offset was generated at from 117° C. to 152° C., and the non-offset temperature width was 35° C. The preservability test revealed 0.7%; and the environmental fluctuation rate of the charge quantity was 0.75. Filming was generated.

The results obtained in the foregoing Examples 1 to 4 and Comparative Examples 1 to 3 are shown in the following Table 1.

TABLE 1

| | Core | Shell | Weight ratio | Wax | Environmental fluctuation rate of charge quantity | Preservability test | Non-offset temperature width | Filming |
|---|---|---|---|---|---|---|---|---|
| Example 1 | A | D | 8/2 | A | AA | AA | BB | AA |
| Example 2 | B | E | 8/2 | B | AA | AA | BB | AA |
| Example 3 | C | D | 8/2 | C | AA | AA | BB | AA |
| Example 4 | C | F | 8/2 | C | AA | AA | AA | AA |
| Comparative Example 1 | A | — | — | A | BB | BB | BB | BB |
| Comparative Example 2 | C | D | 8/2 | D | AA | AA | CC | AA |
| Comparative Example 3 | A | D | 9.5/0.5 | A | BB | BB | CC | BB |

As is clear from the foregoing table, when the invention is employed, a developing agent having excellent low-temperature fixability and satisfactory preservability and charge stability is obtainable. Also, it was noted that when maleinated wax is used as the wax, the non-offset temperature width is more widened in a low temperature region, and the low-temperature fixability is more satisfactory.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent comprising:

a core containing an amorphous polyester resin and a fatty acid ester based wax;

a shell provided on the surface of the core and containing a copolymer of a sodium p-styrenesulfonate monomer and one of acrylic acid and an acrylic ester; and a coloring agent to be further contained in at least one of the core and the shell.

2. The developing agent according to claim 1, which is formed by adding a coagulating agent to a dispersion of a core material containing an amorphous polyester resin and a fatty acid ester based wax to coagulate the core material, thereby forming a core;

and applying a shell material containing a copolymer of a sodium p-styrenesulfonate monomer and one of acrylic acid and an acrylic ester on the surface of the obtained core, adding a coagulating agent to coagulate the shell material on the surface of the core, thereby obtaining a toner particle in which the core is encapsulated by the shell material.

3. The developing agent according to claim 1, wherein the acrylic ester is an acrylic ester selected from the group consisting of ethyl acrylate, propyl acrylate, butyl acrylate, 2-ethylhexyl acrylate, butyl methacrylate, ethyl methacrylate and methyl methacrylate.

4. The developing agent according to claim 1, wherein the acrylic ester includes butyl acrylate.

5. The developing agent according to claim 1, wherein the fatty acid ester based wax has a softening point of from 60 to 120° C.

6. The developing agent according to claim 1, wherein the fatty acid ester based wax includes a reaction product of at least one compound selected among long-chain alkyl group-containing alcohols, longchain alkyl group-containing amines, fluoroalkyl group containing alcohols and fluoro-alkyl group-containing amines, an unsaturated polyhydric carboxylic acid or an acid anhydride thereof and a synthetic hydrocarbon wax.

7. The developing agent according to claim 6, wherein the unsaturated polyhydric carboxylic acid or its anhydride is selected from the group consisting of maleic acid, maleic anhydride, itaconic acid, itaconic anhydride, citraconic acid and citraconic anhydride.

8. The developing agent according to claim 7, wherein the unsaturated polyhydric carboxylic acid or its anhydride is at least one of maleic acid and maleic anhydride.

* * * * *